United States Patent [19]

Kaiser et al.

[11] 3,975,794

[45] Aug. 24, 1976

[54] SPRING HINGE

[75] Inventors: Kenneth L. Kaiser, North Hudson; William Stowik, Hudson, both of Wis.

[73] Assignee: Vollrath Refrigeration, Inc., River Falls, Wis.

[22] Filed: Nov. 22, 1974

[21] Appl. No.: 526,087

[52] U.S. Cl. ..... 16/189; 16/50; 16/76

[51] Int. Cl.[2] ..... E05F 1/08

[58] Field of Search ..... 16/153, 154, 186, 189, 16/DIG. 10, 50, 76

[56] References Cited

UNITED STATES PATENTS

| | | | |
|---|---|---|---|
| 70,921 | 11/1967 | Vetter | 16/153 UX |
| 76,727 | 4/1868 | Esten | 16/153 UX |
| 647,905 | 4/1900 | Roche | 16/154 UX |
| 1,108,298 | 8/1914 | Winter | 16/186 |
| 2,441,455 | 5/1948 | Tetzman | 16/76 X |
| 3,748,688 | 7/1973 | Berkowitz | 16/153 |

*Primary Examiner*—Andrew V. Kundrat
*Attorney, Agent, or Firm*—Arthur L. Morsell, Jr.

[57] ABSTRACT

A cam rise hinge has a swingable strap portion which is cammed up relative to a stationary butt portion when a door on which the strap portion is mounted is swung towards its open position. A coiled wire torsion-compression spring is positioned and mounted so as to be compressed and simultaneously twisted when the strap portion is cammed up. This generates two different forces aiding each other and gravity in swinging the strap portion and door back toward closed position.

8 Claims, 3 Drawing Figures

SPRING HINGE

BACKGROUND OF THE INVENTION

Spring loaded cam rise lift hinges have been employed in the past to lift a door as it is being opened and to generate a force tending to close the door when it is released. In these prior art hinges, the spring is positioned to be compressed when the strap portion of the hinge is cammed up by swinging movement of the door toward its open position. The compression of the spring presses the cam elements together and thereby tends to return the door to its closed position. However, in applications that involve relatively large doors, e.g. heavy walk-in refrigerator doors, the door closing force may not be large enough to completely close the door and latch it, particularly when the door has only been partially opened.

SUMMARY OF THE INVENTION

In the spring hinge of this invention, the door closing force is substantially increased by securing one end of a special torsion-compression spring to the strap portion of the hinge and by securing the other end of the spring to the butt portion of the hinge so that the spring will be simultaneously twisted as it is being compressed by swinging movement of the strap portion toward its open position. The twisting of the spring generates a torsion force which acts directly on the strap portion and adds to the effect of spring assisted gravity in returning the door to its closed position.

DESCRIPTION OF THE PREFERRED EMBODIMENT

Figure 1:
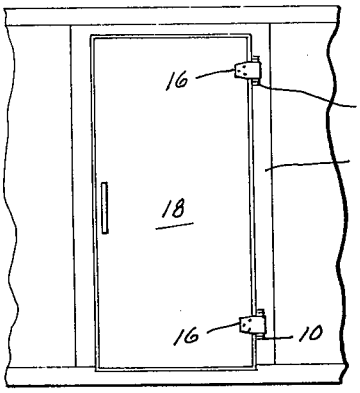
FIG. 1 is a front elevational view of a walk-in refrigerator door swingably mounted on a frame and equipped with a pair of spring hinges of this invention.
Figure 2:
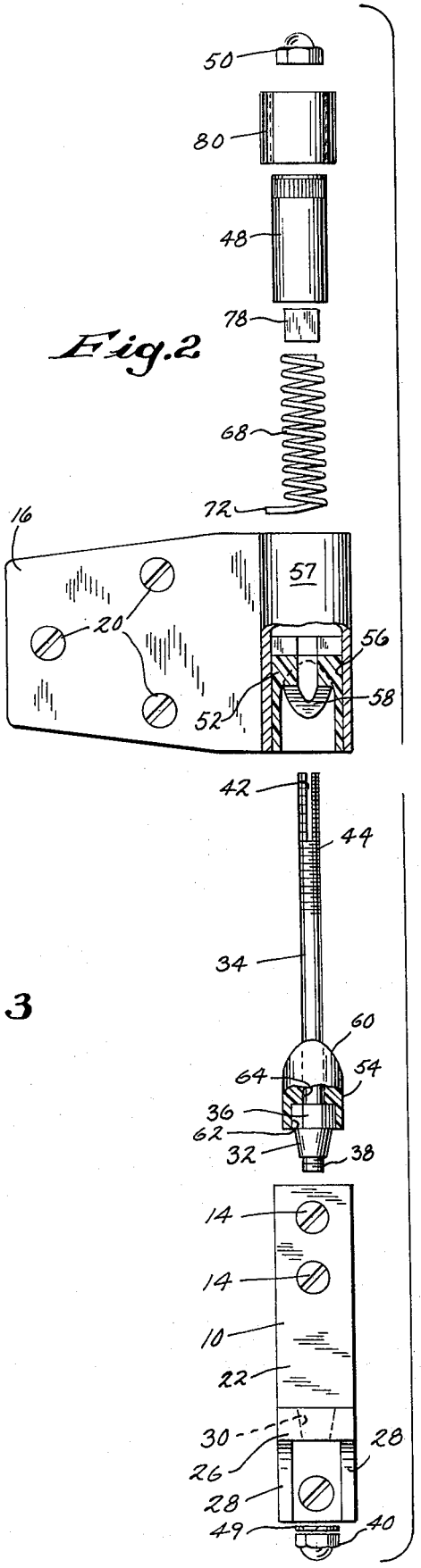
FIG. 2 is an exploded front elevational view of one hinge.

Referring to the drawings, the preferred spring hinge of this invention includes a butt portion 10 which can be attached to a door frame 12 (FIG. 1) by machine screws 14 (FIG. 3) and a strap portion 16 which is swingably mounted on butt portion 10 and can be attached to a door 18 (FIG. 1) by machine screws 20 (FIG. 2). In this example, door 18 is the door of a walk-in refrigerator, but it will be obvious that the invention can also be applied to other doors.

Figure 3:
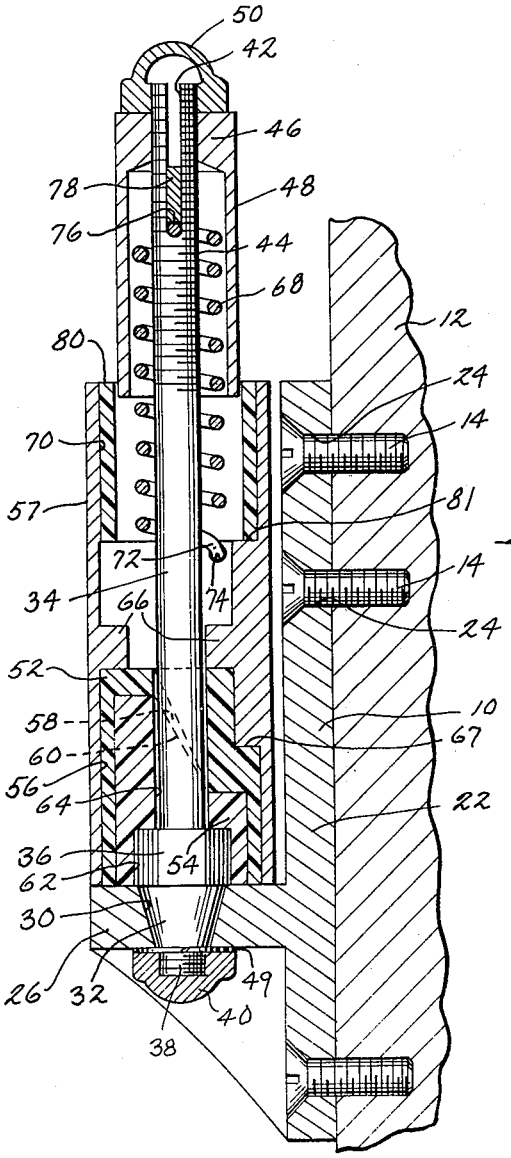
FIG. 3 is a longitudinal sectional view of the hinge of FIG. 2 with the strap portion thereof in its closed position.

As best shown in FIG. 3, butt portion 10 includes a flat plate 22 which has holes 24 therein to accept screws 14 and has a ledge 26 which projects outwardly from the bottom of plate 22 to support strap portion 16 and door 18. Curved bracing ribs 28 extend between the bottom of ledge 26 and lower side edges of plate 22 to help support the same. Plate 22, ledge 26, and ribs 28 are preferably made of suitable metal.

A downwardly tapering hole 30 is formed midway of the width of ledge 26 to receive the tapered enlargement 32 at the lower portion of an upstanding pin 34, there being a hexagonally shaped portion 36 immediately above tapered portion 32. The lower end of pin 34 is threaded at 38 to receive an acorn nut 40 which fastens pin 34 to ledge 26. The upper end of pin 34 is slotted at 42 and is threaded at 44 to receive the threaded, nut-like upper end 46 of a protective cap 48 and to receive a second acorn nut 50. Pin 34 and its enlarged portions 32 and 36 are preferably made of steel. An internal tooth lock washer 49 is used above nut 40.

Cooperating cylindrical cam elements 52 and 54 are fitted within the bore 56 of an enlarged portion 57 of strap 16 around pin 34. The outer cam element 52 is a hollow cylindrical sleeve which carries cam surface 58. The inner cam element 54 has a matching cam surface 60 on its upper edge and has a hexagonal recess 62 in its lower portion to receive the hexagonal portion 36 of pin 34, which passes through a central bore 64 in inner cam element 54. Hexagonal recess 62 and hexagonal portion 36 of pin 34 keep inner cam element 54 from rotating when strap portion 16 is pivoted about pin 34 to open the door. Outer cam element 52 pivots with strap portion 16 and causes cam surface 58 to rotate over cam surface 60.

Cam surfaces 58 and 60 are shaped to cause outer cam element 52 to rise as strap portion 16 is swung toward its open position, i.e. toward the open position of door 18, and to cause outer cam element 52 to move downwardly as strap portion 16 is swung toward its closed position.

Inwardly projecting internal shoulders 66 above the top of outer cam element 52 and shoulder 67 transfer this lifting effect to strap portion 16, which thereby rises when it is swung toward its open position and moves downwardly when it is swung toward its closed position.

Cam elements 52 and 54 are preferably made of a low friction material such as nylon or the like to reduce wear on the cam surfaces 58 and 60.

A coiled wire torsion-compression spring 68 is positioned to be compressed by the rising of strap portion 16 and arranged in a novel manner to be simultaneously twisted by the pivotal movement of strap portion 16. Spring 68 surrounds the upper portion of pin 34, with its lower portion within a bore 70 in strap portion 16. The end 72 of the wire forming spring 68 is bent to engage in a hole 74 in strap portion 16, and the upper end 76 of spring 68 is bent to engage the slot 42 in the upper portion of pin 34. A nylon shim 78 is seated in the slot 42 on top of upper wire end 76 and has ends which project from opposite sides of the slot, with the underside of top 46 of protective cap 48 engaging said projecting ends of the shim. A nylon spacer 80 is seated within the top of bore portion 70 around spring 68 and the bottom of cylinder 48. It rests on an internal shoulder 81

Since the bottom end 72 of spring 68 is secured to strap portion 16 at 74, and since the upper end 76 is secured in the slot 42 of pin 34, pivoting of strap portion 16 toward its open position will cause both endwise compression and twisting of spring 68 to occur simultaneously, the compression being caused by the camming up of strap portion 16, and the twisting being caused by the fact that hole 74 pivots with strap portion 16 while the slot 42 of pin 34 remains stationary. The compression of spring 68 generates a force which aids gravity in causing lowering movement of strap portion 16 toward its closed position when it is released. This is the door closing force that has been relied on in the past to tend to close the door when it is released. However, the door closing force due to spring compression alone may not be adequate to completely close and latch heavy walk-in refrigerator doors such as door 18, particularly when it has been only partially opened. This drawback is overcome in this invention by augmenting the door closing force due to the compression of spring 68 with an additional door closing force due to the twisting of spring 68. The door closing force due to the twisting of spring 68 acts directly on strap portion 16 at the margins of the hole 74 which receives the lower end 72 of spring 68. The torsional door closing force can be selected to be any desired value within design limits by selecting the appropriate torsional characteristics for spring 68. By this means, the combined door closing force can be raised to a level which is sufficient to close and latch heavy walk-in refrigerator doors even when they have only been partially opened.

Various changes and modifications may be made without departing from the spirit of the invention, and all of such changes are contemplated as may come within the scope of the claims.

What we claim is:

1. In a hinge having a butt portion and having a strap portion pivotally mounted on said butt portion for movement between an open position and a closed position, and having cooperating cam members on said butt portion and strap portion for causing said strap portion to rise as it is swung toward its open position and to move downwardly as it is swung toward its closed position, the improvement comprising means including a coiled wire torsion-compression spring positioned to be compressed in an endwise direction when the strap portion rises, said spring having one wire end fixed relative to said butt portion and having its opposite wire end anchored to said strap portion, whereby pivotal movement of said strap portion also causes twisting of said spring simultaneously with the compression thereof, said butt portion having a pin extending vertically upwardly therefrom, and said strap portion being mounted for pivotal movement about the longitudinal axis of said pin, said spring surrounding said pin and the upper portion of said pin being slotted with the upper end of the spring wire received in said slot, a cap on the upper end of said slotted pin surrounding said spring, threaded means for maintaining said cap in a selected position on said pin, and means between said cap and the upper end of said spring for preventing upward movement of said upper end.

2. The hinge of claim 1 wherein said means for preventing upward movement of the upper end of the spring includes a shim positioned within the slotted end of said pin between said cap and said upper wire end of said spring.

3. The hinge of claim 1 wherein the upper end of the slotted pin is threaded, and wherein the cap is threaded and screwed onto the upper end of said slotted pin.

4. The hinge of claim 3 wherein said means for preventing upward movement of the upper end of the spring includes a shim positioned within the slotted end of said pin between said cap and said upper wire end of said spring.

5. In a hinge having a fixed hinge element and having a swingable hinge element for movement between an open and a closed position, having a pin non-rotatably fixed at its inner end to said fixed hinge element and having an outer portion projecting therefrom, having a fixed cam element surrounding the inner end of said pin, and said swingable hinge element having a tubular portion surrounding said pin for pivotal movement around the longitudinal axis of the pin and being axially shiftable, and said tubular portion having a cam element positioned for co-action with the cam element of the fixed hinge portion, the improvement comprising a coiled wire torsion-compression spring surrounding an outer portion of said pin and having one end of its wire anchored to the tubular portion of the swingable hinge element and having its other end interlocked with said non-rotatable pin, said spring being positioned to be compressed in an endwise direction when the tubular portion shifts axially as a result of cam action, and swingable movement of the swingable hinge element also causing twisting of said spring simultaneously with the compression thereof, a cap on the outer end of said pin surrounding said spring, threaded means for maintaining said cap in selected position on said pin, and means between said cap and the outer end of said spring for limiting movement of the adjacent end of the spring.

6. The hinge of claim 5 wherein the outer end of said pin is slotted, and wherein said means for limiting movement of the spring includes a shim positioned with said slotted end between said cap and the slot inserted end of said spring.

7. The hinge of claim 5 in which the outer end of the pin is threaded, and in which the cap is threaded onto said outer end.

8. The hinge of claim 7 wherein said threaded outer end of the pin is slotted, and wherein said means for limiting upward movement of the spring includes a shim positioned within said slotted end between said cap and the slot inserted end of said spring.

* * * * *